US009863690B1

(12) United States Patent
Demiroez et al.

(10) Patent No.: US 9,863,690 B1
(45) Date of Patent: Jan. 9, 2018

(54) HOME APPLIANCE DOOR

(71) Applicant: BSH HAUSGERAETE GMBH, Munich (DE)

(72) Inventors: Taha Demiroez, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/360,173

(22) Filed: Nov. 23, 2016

(51) Int. Cl.

| | |
|---|---|
| ***F25D 23/02*** | (2006.01) |
| ***E06B 7/02*** | (2006.01) |
| ***E06B 5/00*** | (2006.01) |
| ***E06B 3/70*** | (2006.01) |
| ***F25D 23/04*** | (2006.01) |

(52) U.S. Cl.
CPC ..... *F25D 23/02* (2013.01); *E06B 3/70* (2013.01); *E06B 5/00* (2013.01); *E06B 7/02* (2013.01); *F25D 23/028* (2013.01); *F25D 23/04* (2013.01); *E06B 2003/7051* (2013.01)

(58) Field of Classification Search
CPC ..... F25D 23/02; F25D 23/028; F25D 23/04; F25D 2323/02; F25D 2400/18
See application file for complete search history.

(56) References Cited

U.S. PATENT DOCUMENTS

| | | | | |
|---|---|---|---|---|
| 9,572,428 | B2 * | 2/2017 | Seeley | F25D 25/024 |
| 2010/0109496 | A1 * | 5/2010 | Grasy | F25D 23/04 312/404 |
| 2012/0293056 | A1 * | 11/2012 | Kim | A47B 96/16 312/405.1 |
| 2013/0167474 | A1 * | 7/2013 | Carlson | F25D 23/028 52/784.15 |
| 2014/0366569 | A1 * | 12/2014 | Babinski | F25D 25/024 62/377 |
| 2016/0305706 | A1 * | 10/2016 | Lim | F25D 23/025 |
| 2016/0370071 | A1 * | 12/2016 | Koo | F25D 17/065 |

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

For the purpose of providing a home appliance device with improved characteristics regarding a user convenience, a home appliance door, in particular a home chiller appliance door, is proposed: The home appliance door has at least one door unit with an outer wall and an inner wall; and at least one covering element which at least partly covers at least one feature of the inner wall.

12 Claims, 4 Drawing Sheets

HOME APPLIANCE DOOR

BACKGROUND OF THE INVENTION

The invention relates to a home appliance door, for example a home chiller appliance door, and to a method for assembly of a home appliance door.

From the prior art a home appliance door is already known. The home appliance door comprises a door unit having an inner wall and an outer wall. A decor panel is located on the inner wall, in an assembled state. The main function of the decor panel is to improve the design of the inner wall of the door unit.

SUMMARY OF THE INVENTION

An objective of the invention is, in particular, to provide a home appliance device with improved characteristics regarding a user convenience. This objective is achieved, according to the invention, while further implementations and further developments of the invention may be gathered from the dependent claims.

A home appliance door, for example a home chiller appliance door, is proposed, comprising: at least one door unit having an outer wall and an inner wall which in particular encompass at least one interior space which is at least partly and preferably at least mostly filled with insulation material; and at least one covering element which at least partly or at least mostly or by considering tolerances completely covers at least one feature of the inner wall.

By a "home appliance door" is in particular to be understood a door of a home appliance device and/or of a home appliance. By a "home appliance device" is in particular to be understood at least a portion, preferably a sub-assembly group, of a home appliance. The home appliance is in particular provided for storing and preferably tempering victuals such as beverages, meat, fish, vegetables, fruits, milk and/or dairy products in at least one operating state, advantageously for the purpose of enhancing a keepability of the stored victuals. For example, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven and/or a steamer and/or a microwave. Alternatively, the home appliance could also be embodied as a home appliance for cleaning, e.g. a washing machine and/or a dryer and/or a dishwasher. The home appliance may in particular comprise at least two, in particular at least three and preferably at least four home appliance devices.

A "door unit" is in particular to be understood as a unit which is, in at least one assembled state, connected to an appliance body in a movable and in particular swiveling fashion and which at least partly defines, in at least one operating state, at least one storage space. In at least one operating state the door unit in particular defines the storage space together with the appliance body. The door unit in particular comprises at least one seal, which is in particular provided for sealing at least one gap between the inner wall and the appliance body in at least one operating state. The door unit itself, in particular without the covering element, is in particular sufficient for closing at least one storage space and/or for sealing at least one gap between the inner wall and the appliance body. The door unit can, for example, at least partly comprise at least one stamped part and/or at least one stamped portion. Alternatively and/or additionally, the door unit can for example comprise at least partly one thermoforming part and/or at least one thermoforming portion.

The appliance body is in particular part of a home appliance device, which in particular also comprises the home appliance door. An "appliance body" is in particular to be understood as a unit at least partly defining at least one storage space and in particular defining the storage space at least substantially together with at least one home appliance door. In particular, the home appliance device comprises, in at least one operating state, the home appliance door. The appliance body and the home appliance in particular define the storage space in at least one operating state at least substantially and preferably by considering tolerances completely. The appliance body in particular comprises at least two, in particular at least four and preferably at least five walls. The walls in particular delimit the storage space. The walls may in particular be embodied as a lateral wall and/or as a rear wall and/or as a bottom wall and/or as a top wall. The appliance body in particular has two lateral walls, preferably opposite each other, one rear wall, one bottom wall and one top wall, which is preferably situated opposite the bottom wall.

In at least one operating state, the inner wall of the door unit is in particular located facing the storage space and/or the appliance body, in particular the rear wall of the appliance body. In at least one operating state, the outer wall is in particular located facing a user. In at least one assembled state, the inner wall and the outer wall are connected and/or fixed to one another, thereby in particular defining at least one interior space. The interior space is, in at least one assembled state, in particular at least partly and preferably at least mostly filled with insulation material. The inner wall and/or the outer wall can for example be in particular at least partly thermoforming parts/a thermoforming part.

The term "at least mostly" with reference to an object is in particular to mean by more than 50% or more than 65% or by more than 80% or by more than 95% of that object, in particular of a surface area and/or of a volume and/or of a mass of the object. An "operating state" is in particular to be understood as a state in which the storage space is closed and an access to the storage space is prevented, in particular by the door unit. In the operating state, the door unit and the appliance body are in particular located with respect to one another in a manner with a maximum contact area.

A "covering element" is in particular to be understood as an element having the main function of covering at least one feature of the inner wall. For example, the covering element can in particular have at least one further function which is of less priority than the main function. The main function of the covering element is in particular the reason for using the covering element. An element covering at least one feature of the inner wall and having a main function that differs from covering at least one feature of the inner wall is in particular not to be understood as a covering element. The covering element can for example be in particular at least partly a stamped part. In particular, the covering element differs from at least one door bin and/or shelf.

The term that the covering element "at least partly" covers at least one feature of the inner wall is in particular to mean that the covering element covers more than 50% or by more than 65% or by more than 75% or by more than 85% of the feature of the inner wall.

In this context, "configured" is in particular to mean specifically programmed, designed and/or equipped. By an object being configured for a certain function is in particular to be understood that the object implements and/or fulfills said certain function in at least one application state and/or operating state.

By means of the invention, in particular a high level of convenience for a user can be provided. Features of the inner wall and/or located on the inner wall can in particular be covered in an easy and/or cost-saving manner. The home appliance door and in particular the covering element can in particular be used for several and preferably for any brands. It is in particular possible to change the design of the covering element in an easy manner, in particular just using different types of material and/or coloring, thereby in particular creating different designs for different brands and/or types of home appliance doors.

Further, it is proposed that the covering element is embodied as a covering plate. The covering element has in particular at least one longitudinal extension and at least one transverse extension, which are at least 5 times or at least 10 times or at least 20 times or at least 50 times larger than at least one thickness of the covering element. In this context, a "longitudinal extension" of an object is in particular to be understood as an extension of the longest side of an imaginary smallest rectangular cuboid just still entirely encompassing the object. In this context, a "transverse extension" of an object is in particular to be understood as an extension of the second-longest side of an imaginary smallest rectangular cuboid just still entirely encompassing the object. In this context, a "thickness" of an object is in particular to be understood as an extension of the shortest side of an imaginary smallest rectangular cuboid just still entirely encompassing the object. In particular, the longitudinal extension and the transverse extension and the thickness are perpendicular to one another, respectively. On account of this, the covering element can in particular be produced and/or manufactured in an easy and/or fast manner.

Further, it is proposed that the covering element is fixed to the inner wall. As a result of this, a high stability can in particular be provided.

The covering element can in particular be fixed to the inner wall by means of a friction-fit connection and/or by means of a form-fit connection. Preferably the covering element is fixed to the inner wall by means of an adhesive bond. For example, the covering element can be fixed to the inner wall by means of a tape and/or double-sided tape. In this way, in particular a stable and/or cost-saving implementation can be provided. A usage of screws can in particular be avoided, thus in particular reducing the number of parts used.

The feature of the inner wall and/or located on the inner wall which may be covered by the cover element can in particular comprise quality problems, such as in particular a usage of too many parts and/or at least one gap located on the inner wall and/or at least one scratch located on the inner wall. Additionally and/or alternatively, the feature can in particular comprise mechanical parts, such as in particular at least one rail and/or at least one screw and/or at least one air duct and/or at least one elbow and/or mechanical details. Preferably, the feature comprises at least one re-enforcing element and/or at least one air duct and/or at least one rail of the inner wall. The re-enforcing element strengthens and/or reinforces in particular the inner wall and/or the door unit. In at least one assembled state, the rail is in particular provided for mounting of at least one door bin in particular of the home appliance door. As a result of this, a high-grade convenience for a user can in particular be provided.

In an exemplary implementation of the invention it is proposed that the home appliance door further comprises at least one rail. For example, the rail and the covering element can in particular be connected to each other, wherein the rail can in particular be connected to a surface of the covering element. Alternatively, the rail and the covering element can in particular be made of one piece. The rail can in particular be embodied as a projection of the covering element. Preferably the rail and the door unit are in particular connected to each other, wherein the rail is in particular connected to the inner wall of the door unit. For example, the covering element can comprise at least one recess through which the rail projects. The rail and the recess of the covering element can in particular be adapted to one another, in particular in size and/or form and/or location. In particular, the rail and the recess can be located correspondingly to one another. It is also proposed that the rail may be located at least completely behind the covering element. The covering element defines at least one plane behind which the rail is located. For example, the rail can be covered by the covering element. The covering element may comprise at least one recess through which the rail can be seen in a front view. This allows, in particular, providing a compact implementation.

Further, it is proposed that the home appliance door may further comprise at least one door bin and that the covering element comprises at least one recess through which the door bin may be fixed to the rail. In particular, the door bin may be provided for storing victuals to be cooled and/or tempered, for example bottles and/or milk and/or juice and/or butter and/or food and/or groceries. The door bin can for example be fixed to the rail in a permanent fashion. Alternatively, the door bin may be fixed to the rail in a releasable fashion. As a result of this, a high convenience for a user can in particular be provided.

Additionally, it is proposed that the inner wall comprises at least one groove, in which the rail is located. In particular, the inner wall comprises at least one delimiting element which in particular delimits and/or defines the groove. In this context, a "delimiting element" is in particular to be understood as a portion of the inner wall, defining and/or bordering the groove. The groove can in particular be a ridge of the inner wall. In particular, the groove is opened towards the covering element. This allows, in particular, providing a compact implementation.

Additionally, it is proposed that the home appliance door further comprises at least one support element located between the inner wall and the outer wall and attached to a rear side of at least one delimiting element of the inner wall, which delimits the groove. In this context, a "support element" is in particular to be understood as an element, being separate from the inner wall and supporting and/or reinforcing the groove and/or the delimiting element and/or the inner wall. In at least one mounted state, the support element is in particular located within the interior space in particular defined by the outer wall and the inner wall. In particular, the rail is fixed to the support element in at least one mounted state, in particular by means of at least one fixing element. The door unit in particular comprises at least one fixing element, which in particular fixes the rail to the support element in at least one mounted state. For example, the fixing element can be a latching element. The fixing element may also be a screw. The support element in particular is embodied at least mostly of metal. The support element may have at least one at least essentially U-shaped region which is in particular attached to the rear side of the delimiting element. The support element may have at least one further region contacting a rear side of the inner wall beside the groove. Alternatively and/or additionally, the support element may have at least one further region extending into the interior space without contacting the inner wall and the outer wall. As a result of this, an improved fixation of the support element by at least one solidified insulation material, located within the interior space, can in particular be provided. For example, the home appliance door can comprise several support elements, being arranged along a height direction of the door unit. Alternatively, the home appliance door can comprise exactly one support element for each delimiting element of the inner wall, e.g. two support elements in total. The support element can for example be an extruded part. In this way, the rail is in particular fixed to the inner wall and/or to the solidified insulation material and/or to the support element. The rail may not be fixed to the covering element. As a result of this, no forces acting on the rail are transmitted onto the covering element.

In addition, it is proposed that the covering element comprises at least one air recess, which is located correspondingly to at least one air duct of the inner wall. The home appliance door can in particular comprise at least one ventilation which in particular leads to the air duct of the inner wall. On account of this, a storage time of victuals to be cooled and/or tempered which are stored in the storage space can in particular be prolonged.

For example, the covering element can in particular be mounted to an in particular flat surface of the inner wall. For example, the inner wall may comprise at least one flange on which the covering element is mounted. As a result of this, a high stability can in particular be provided.

Furthermore, it is proposed that the covering element and at least one portion of the inner wall may be arranged flush with each other. The term that the covering element and at least one portion of the inner wall are arranged "flush" with each other is in particular to mean that a small offset and/or tolerances are admissible and/or allowed. On account of this, a compact implementation can in particular be provided. In particular, requirements of a flat door concept can be fulfilled. The at least one portion of the inner wall may surround one, two or all edges of the covering element.

It is also proposed that the covering element is at least mostly made of metal, e.g. sheet metal. For example, the covering element can in particular be at least mostly made of aluminum and/or stainless steel and/or galvanized steel. The covering element can in particular be painted and/or varnished. As a result of this, a high stability can in particular be provided.

A convenience for a user can in particular be enhanced by a home appliance device, in particular a home chiller appliance device, comprising at least one home appliance door according to the invention.

A convenience for a user can in particular be further improved by a home appliance, in particular a home chiller appliance, comprising at least one home appliance device, in particular at least one home chiller appliance device, according to the invention.

A comfortable and/or convenient solution can in particular be provided by a method for assembly of a home appliance door, in particular a home chiller appliance door, according to the invention; the home appliance door comprising: at least one door unit having an outer wall and an inner wall; at least one feature of the inner wall being at least partly covered.

Herein the home appliance door and/or the home appliance device is not to be limited to the application and implementation described above. In particular, for the purpose of fulfilling a functionality herein described, the home appliance door and/or the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
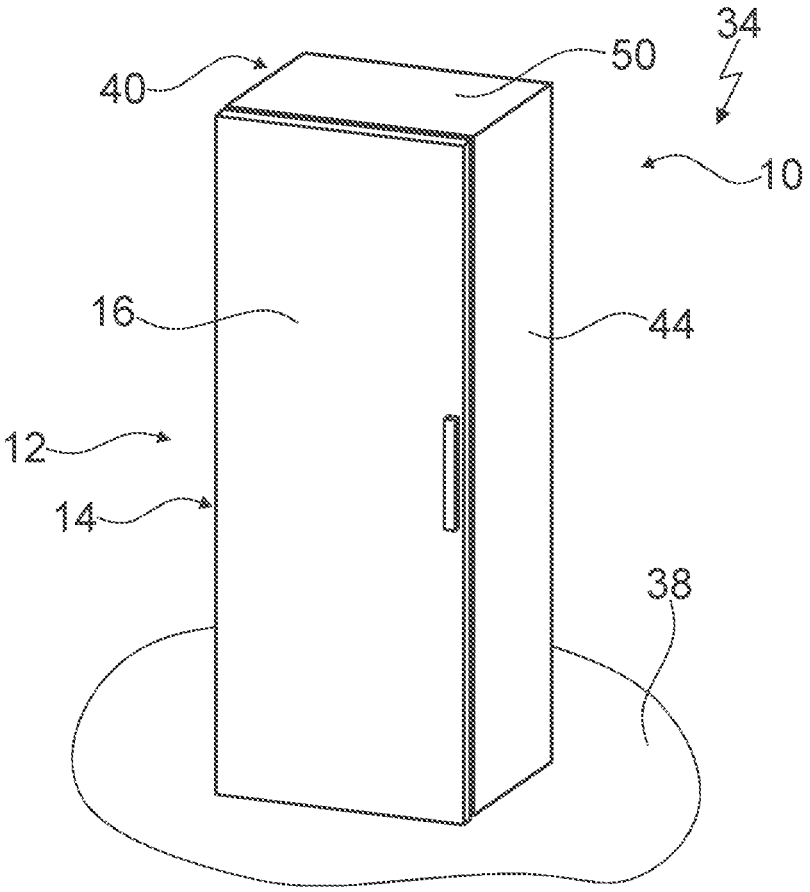
FIG. 1 a home appliance comprising a home appliance device which comprises a home appliance door in an operating state, in a schematic front view, FIG. 2 a home appliance comprising a home appliance device, which comprises a home appliance door in an opened state, in a schematic front view, FIG. 3 a door unit, a rail and a covering element of the home appliance door, in a schematic exploded view, FIG. 4 a portion of the door unit, the rail and the covering element in an assembled state, in a schematic view, FIG. 5 a portion of an inner wall of the door unit and the covering element in an assembled state, in a schematic sectional view and FIG. 6 a cross-section along line VI-VI in FIG. 2.
Figure 2:
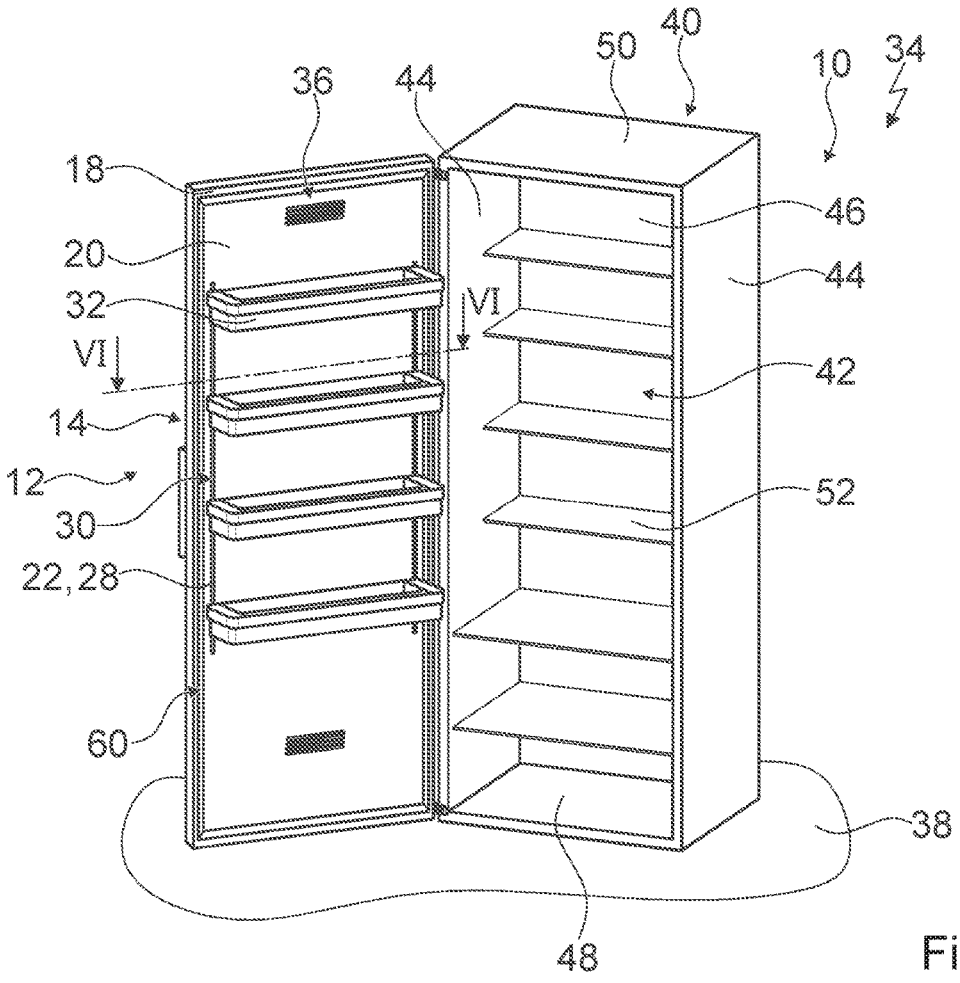
Figure 3:
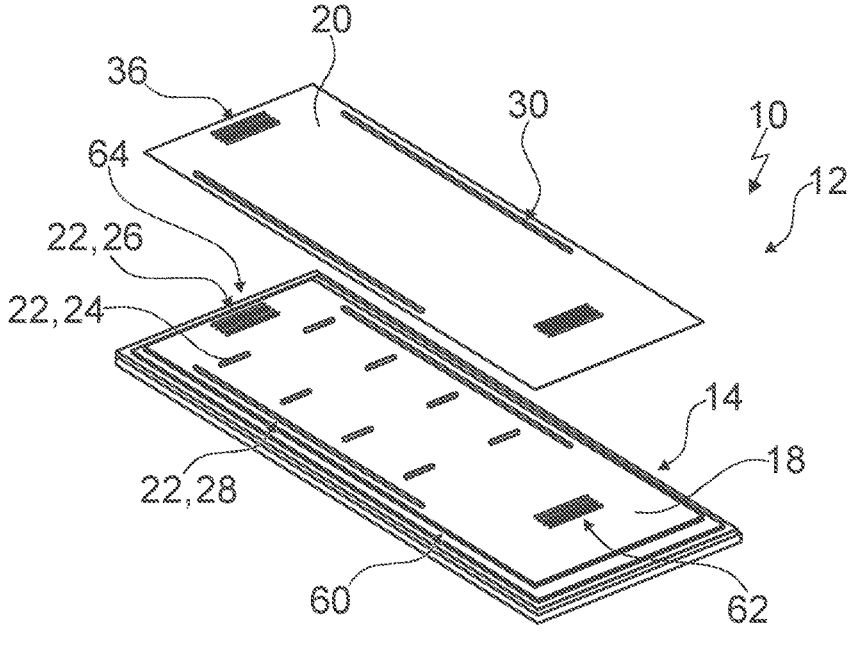
Figure 4:
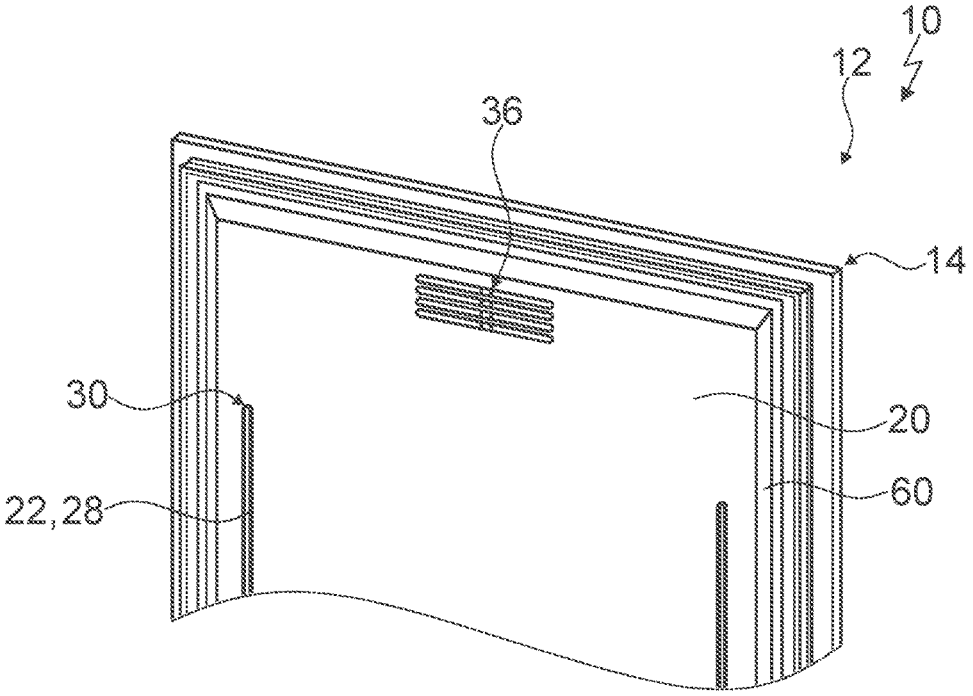

FIG. 1 shows a home appliance 34 comprising a home appliance device 10, in a schematic perspective view. The home appliance 34 is embodied as a home chiller appliance. The home appliance device 10 is embodied as a home chiller appliance device.

In the present embodiment the home appliance 34 is embodied as a refrigerator. The home appliance 34 could further be embodied in particular as a wine cooler, a climate cabinet, an ice-box, a freezer and/or a refrigerator-freezer combination.

In FIG. 1 the home appliance device 10 is shown in an installation position. The home appliance device 10 is installed on a base 38. The base 38 defines a substantially horizontal plane.

The home appliance device 10 comprises an appliance body 40. The appliance body 40 partly defines an appliance housing. The appliance body 40 is installed on the base 38 substantially upright.

The appliance body 40 partly defines a storage space 42. The appliance body 40 comprises walls 44, 46, 48, 50. The walls 44, 46, 48, 50 delimit the storage space 42. The appliance body 40 comprises two lateral walls 44, preferably opposite each other. The appliance body 40 comprises a rear wall 46. The appliance body 40 comprises a bottom wall 48. The appliance body 40 comprises a top wall 50, preferably opposite the bottom wall 48.

The home appliance device 10 comprises at least one insert 52. In the present case the home appliance device 10 comprises six inserts 52. It is conceivable that the home appliance device 10 may comprise a differing number of inserts 52 as is deemed advantageous by someone skilled in the art. The home appliance device 10 may preferably comprise a combination of different embodiments of inserts 52, for example at least one insert 52 embodied as a shelf and at least one further insert 52 embodied as a bottle holder. For the sake of clarity, in the following only one insert 52 is given a reference numeral and is described in detail. The following description may be transferred to further inserts 52 accordingly.

The home appliance device 10 comprises a home appliance door 12. The home appliance door 12 is connected to the appliance body 40. In a mounted state, the home appliance door 12 is rotatably connected to the appliance body 40.

Figure 5:
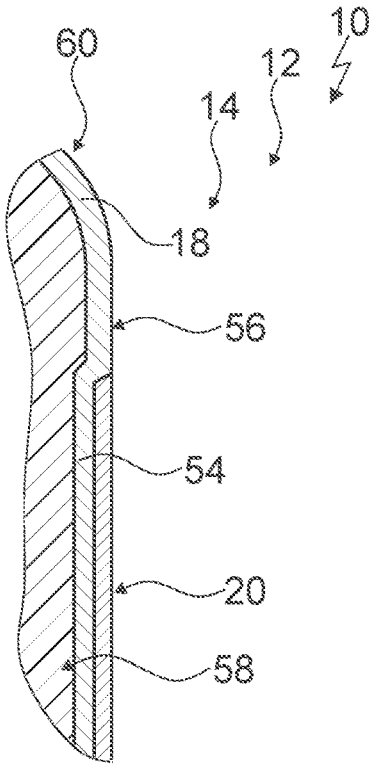
Figure 6:
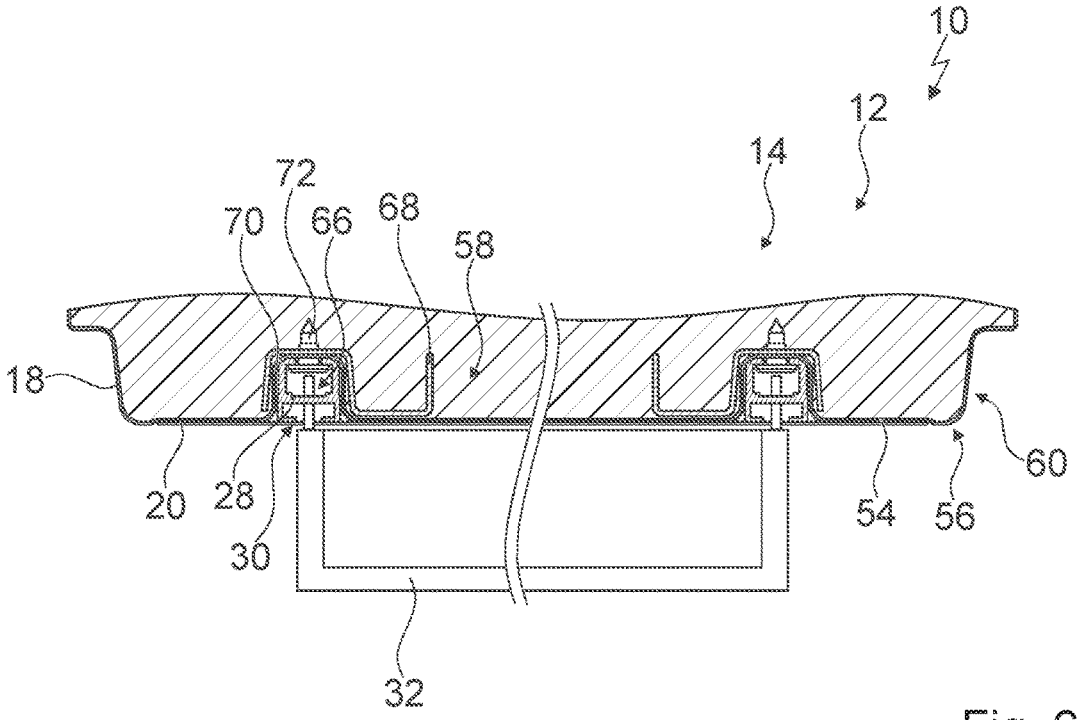

The home appliance door 12 comprises a door unit 14. The door unit 14 has an outer wall 16 and an inner wall 18. In an assembled state, the inner wall 18 and the outer wall 16 are connected to one another. The inner wall 18 and the outer wall 16 define an interior space 58 (compare FIGS. 5 and 6). The interior space 58 is, in an assembled state, mostly filled with insulation material.

The home appliance door 12 comprises a covering element 20. In an assembled state, the covering element 20 covers several features 22 of the inner wall 18. The covering element 20 is, in the present embodiment, mostly made of metal. The covering element 20 is embodied as a covering plate.

The home appliance door 12 comprises at least one re-enforcing element 24. In the present embodiment, the home appliance door 12 comprises eight re-enforcing elements 24. For the sake of clarity, in the following only one re-enforcing element 24 is given a reference numeral and is described in detail. The following description may be transferred to further re-enforcing elements 24 accordingly.

The re-enforcing element 24 is located on the inner wall 18. In an assembled state, the re-enforcing element 24 is connected to the inner wall 18. For example, the re-enforcing element 24 and the inner wall 18 can be made in one piece. The feature 22 comprises the re-enforcing element 24.

The home appliance door 12 comprises an air duct 26. In an alternate embodiment, the home appliance door 12 may comprise more than one air duct 26.

The air duct 26 comprises an air duct inlet 62. The air duct inlet 62 is located in a bottom part of the home appliance door 12. The air duct 26 comprises an air duct outlet 64. The air duct outlet 64 is located in a top part of the appliance door 12.

The air duct 26 is located on the inner wall 18. In an assembled state, the air duct 26 and the inner wall 18 are made in one piece. The feature 22 comprises the air duct 26.

The home appliance door 12 comprises at least one rail 28. In the present embodiment, the home appliance door 12 comprises two rails 28. For the sake of clarity, in the following only one rail 28 is given a reference numeral and is described in detail. The following description may be transferred to the further rail 28 accordingly.

The rail 28 is located on the inner wall 18. In an assembled state, the rail 28 is connected to the inner wall 18. For example, the rail 28 and the inner wall 18 can be made in one piece. The feature 22 partly comprises the rail 28, which means that in particular only a portion of the rail 28 is part of the feature 22.

The inner wall 18 comprises a groove 66. In an assembled state, the rail 28 is located in the groove 66. The inner wall 18 comprises a delimiting element 70. The delimiting element 70 delimits the groove 66.

The home appliance door 12 comprises a support element 68. In an assembled state, the support element 68 is located between the inner wall 18 and the outer wall 16. The support element 68 is located in the interior space 58, in an assembled state. In an assembled state, the support element 68 is attached to a rear side of the delimiting element 70 by means of a fixing element 72. In the present embodiment the fixing element 72 is a screw.

In an assembled state, the covering element 20 is fixed to the inner wall 18. In the present embodiment, the covering element 20 is fixed to the inner wall 18 by means of adhesive bonding.

The inner wall 18 comprises a flange 54. In an alternative embodiment, the inner wall 18 can comprise a greater number of flanges 54, for example at least one flange 54 per side of the inner wall 18. The covering element 20 is, in an assembled state, mounted on the flange 54.

The flange 54 is in the present embodiment curved in a direction towards the outer wall 16. In an assembled state, the covering element 20 and a portion 56 of the inner wall 18 are arranged flush with each other. The portion 56 of the inner wall 18 is part of a frame 60 of the inner wall 18.

The home appliance door 12 comprises at least one frame 60. The frame 60 is located on the inner wall 18. In an assembled state, the frame 60 is connected to the inner wall 18. For example, the frame 60 and the inner wall 18 can be made in one piece. The frame 60 projects over a surface of a base body of the inner wall 18.

The covering element 20 is, in an assembled state, located in front of the rail 28. In an assembled state, the rail 28 is located completely behind the covering element 20.

In the present embodiment, the home appliance door 12 comprises four door bins 32. For the sake of clarity, in the following only one door bin 32 is given a reference numeral and is described in detail. The following description may be transferred to the further door bin 32 accordingly.

In the present embodiment, the covering element 20 comprises two recesses 30. For the sake of clarity, in the following only one recess 30 is given a reference numeral and is described in detail. The following description may be transferred to the further recess 30 accordingly.

In an assembled state, the recess 30 is located correspondingly to the rail 28. In an assembled state, the door bin 32 is fixed to the rail 28 through the recess 30.

In an assembled state, the covering element 20 is located between a base body of the inner wall 18 and the door bin 32. In an operating state, the door bin 32 is located inside the storage space 42.

In the present embodiment, the covering element 20 comprises two air recesses 36. For the sake of clarity, in the following only one air recess 36 is given a reference numeral and is described in detail. The following description may be transferred to the further air recess 36 accordingly. In an assembled state, the air recess 36 is located correspondingly to the air duct 26.

In a method for assembly of the home appliance door 12 several features 22 of the inner wall 18 are partly covered.

The following is a summary list of reference numerals and the corresponding structure used in the above description of the invention:

10 Home appliance device
12 Home appliance door
14 Door unit
16 Outer wall
18 Inner wall
20 Covering element
22 Feature
24 Re-enforcing element
26 Air duct
28 Rail
30 Recess
32 Door bin
34 Home appliance
36 Air recess
38 Base
40 Appliance body
42 Storage space
44 Wall
46 Wall
48 Wall
50 Wall
52 Insert
54 Flange
56 Portion
58 Interior space
60 Frame
62 Air duct inlet
64 Air duct outlet
66 Groove
68 Support element
70 Delimiting element
72 Fixing element

The invention claimed is:

1. A home appliance door or home chiller appliance door, comprising:

at least one door unit having an outer wall and an inner wall;

the inner wall having at least one groove, at least one delimiting element delimiting the at least one groove and at least one feature;

at least one covering element at least partly covering the at least one feature of the inner wall;

at least one rail located in the at least one groove and at least completely behind the at least one covering element; and at least one support element located between the inner wall and the outer wall and attached to a rear side of the at least one delimiting element.

2. The home appliance door according to claim 1, the covering element being embodied as a covering plate.

3. The home appliance door according to claim 1, the covering element being fixed to the inner wall.

4. The home appliance door according to claim 3, the covering element being fixed to the inner wall by an adhesive bond.

5. The home appliance door according to claim 1, the feature comprising at least one of:

at least one re-enforcing element or at least one air duct or at least one rail of the inner wall.

6. The home appliance door according to claim 1, further comprising at least one door bin and the covering element including at least one recess through which the door bin is fixed to the rail.

7. The home appliance door according to claim 1, the inner wall including at least one flange on which the covering element is mounted.

8. The home appliance door according to claim 7, the covering element and at least one portion of the inner wall being arranged flush with each other.

9. The home appliance door according to claim 1, the covering element being at least mostly made of metal.

10. A home appliance device or home chiller appliance, comprising at least one home appliance door according to claim 1.

11. A home appliance or a home chiller appliance, comprising at least one home appliance device according to claim 10.

12. A home appliance door or home chiller appliance door, comprising:

at least one door unit having an outer wall and an inner wall;

the inner wall having at least one feature and at least one air duct; and at least one covering element at least partly covering the at least one feature, the at least one covering element having at least one air recess located correspondingly to the at least one air duct of the inner wall.

* * * * *